United States Patent [19]

Früh et al.

[11] Patent Number: 4,809,481

[45] Date of Patent: Mar. 7, 1989

[54] METHOD AND APPARATUS FOR SWITCHING ON AND OFF A PACKING MACHINE

[75] Inventors: Hans R. Früh, Beringen; Martin Tanner, Löhningen, both of Switzerland

[73] Assignee: SIG Schweizerische Industrie-Gesellschaft, Neuhausen am Rheinfall, Switzerland

[21] Appl. No.: 122,195

[22] Filed: Nov. 18, 1987

[30] Foreign Application Priority Data

Nov. 19, 1986 [CH] Switzerland ..... 4623/86

[51] Int. Cl.[4] ..... B65B 57/00

[52] U.S. Cl. ..... 53/55; 53/67; 53/77; 53/505; 53/452

[58] Field of Search ..... 53/452, 456, 55, 52, 53/77, 69, 67, 506, 505, 57, 563, 562, 568

[56] References Cited

U.S. PATENT DOCUMENTS

| | | | |
|---|---|---|---|
| 3,982,376 | 9/1976 | Ikeda | 53/55 X |
| 4,607,252 | 8/1986 | Neri | 53/77 X |
| 4,683,704 | 8/1987 | Vorachek et al. | 53/77 X |
| 4,722,168 | 2/1988 | Heaney | 53/77 X |

FOREIGN PATENT DOCUMENTS

| | | |
|---|---|---|
| 394932 | 12/1965 | Switzerland . |
| 434953 | 10/1967 | Switzerland . |
| 435098 | 10/1967 | Switzerland . |
| 595241 | 2/1978 | Switzerland . |

*Primary Examiner*—James F. Coan

*Attorney, Agent, or Firm*—Spencer & Frank

[57] ABSTRACT

A method of operating a packaging line comprises the following steps:

(a) sensing the absence and presence of an operationally sufficient quantity of wrapper sheet supply for a bag making station of the packaging line;

(b) sensing the absence and presence of an operationally sufficient quantity of bulk material supply in a metering and filling station of the packaging line;

(c) sensing the absence and presence of the bags on a first conveying lane of the packaging line;

(d) sensing the quantity of the bags on a second, accumulating conveying lane which adjoins the first conveying lane and receives the filled and closed bags therefrom, to determine a receptiveness or non-receptiveness of the second conveying lane;

(e) allowing a start-up of the packaging line only if the sensing steps (a) and (b) determine a presence of bags on the first conveying lane and the sensing step (d) determines a receptiveness of the second conveying lane; and (f) allowing the stoppage of the packaging line only if the sensing step (c) determines an absence of bags from the first conveying lane.

8 Claims, 2 Drawing Sheets

METHOD AND APPARATUS FOR SWITCHING ON AND OFF A PACKING MACHINE

BACKGROUND OF THE INVENTION

During the operation of packing machines (packaging lines) not infrequently events occur which require that the machine be brought to a stop. Such occurrences are:

(a) the lack of wrapping material caused by using up the wrapper reel or by a severance of the wrapper (paper) web;

(b) the lack of the bulk material to be packaged, caused, for example, by improper resupply; and (c) the accumulation track (conveying lane) for removing or further processing the filled and closed packages is full, either because of a failure to remove the packages or a stoppage or slowdown of a machine wrapping the finished packages together to obtain collection boxes.

In the event of a defective operation of, for example, the above-outlined kind, the apparatus should be switched off to prevent further defects such as, for example, a soiling with adhesive in case no wrapping material is present or forwarding only partially filled or even empty bags in case of missing bulk material or the crowding of bags on the track of accumulation and damage thereto by the crushing effect of pressure forces or by falling off the overcrowded accumulation track.

It is known that when the packing machine resumes normal operation, at least some of the packages may be defective until the apparatus has passed a transient period. Such defective packages which have to be removed, result in loss of material and time. The stoppage of the machine itself, however, leads to disadvantages such as drying of the adhesive on the wrapper material, resulting in defective seals of the later-formed bags or such bags could accidentally open. Further, at the bag-forming station an escape of the adhesive may occur which subsequently has to be removed manually from mandrels or shaping boxes. It has been found that the machine could not be automatically restarted because, for example, pieces of the wrapper material between the paper-advancing rollers and bag-forming station have caused disturbances so that often maintenance personnel had to assume both the monitoring and the restarting which again has resulted in significant loss in labor and material.

SUMMARY OF THE INVENTION

It is an object of the invention to provide an improved method of operating a packing machine, by means of which stoppage and restart of the machine may be effected without the above-outlined difficulties and without loss of labor and material.

This object and others to become apparent as the specification progresses, are accomplished by the invention, according to which, briefly stated, the method of operating the packaging line comprises the following steps:

(a) sensing the absence and presence of an operationally sufficient quantity of wrapper sheet supply for a bag making station of the packaging line;

(b) sensing the absence and presence of an operationally sufficient quantity of bulk material supply in a metering and filling station of the packaging line;

(c) sensing the absence and presence of the bags on a first conveying lane of the packaging line;

(d) sensing the quantity of the bags on a second, accumulating conveying lane which adjoins the first conveying lane and receives the filled and closed bags therefrom, to determine a receptiveness or non-receptiveness of the second conveying lane;

(e) allowing a start-up of the packaging line only if the sensing steps (a) and (b) determine a presence of bags on the first conveying lane and the sensing step (d) determines a receptiveness of the second conveying lane; and (f) allowing a stoppage of the packaging line only if the sensing step (c) determines an absence of bags from the first conveying lane.

DESCRIPTION OF THE PREFERRED EMBODIMENTS

Figure 1:
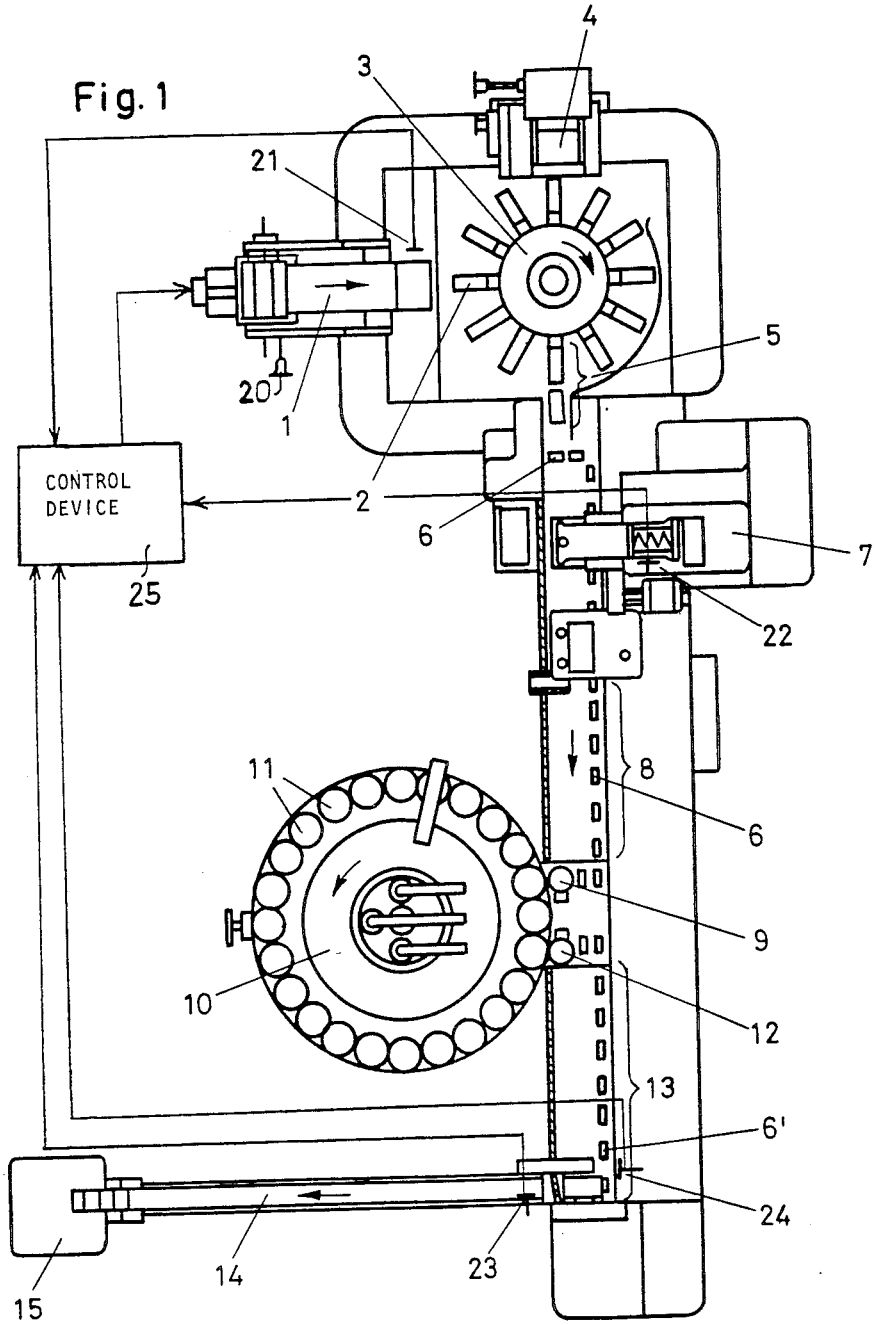
FIG. 1 is a schematic plan view of a packing machine with which the invention is practiced.

The packing machine (packaging line) illustrated in FIG. 1 is generally known and is described, for example, in Swiss Patent No. 394,932. The wrapper material 1 for making bag-like receptacles 6 is advanced to a stepwise-rotated mandrel wheel 3 and is shaped to obtain bags 6. As the mandrel wheel 3 rotates, the bags 6 are introduced into a station 4 where a further wrapper is added to the bags 6 for forming an external bag or cardboard box thereon. The bags 6 are then pulled off the mandrels 2 at a station 5 and are advanced in an upright position to a dosing and filling station 7.

In the zone of the conveyor track 8 the upwardly open bags are closed with a transverse seam by heated sealing shoes in such a manner that, for example, in the middle of the transverse seams there remains an opening of 1–2 cm through which subsequently air may be withdrawn from the bags.

The bags 6 moved on the conveyor track 8 in the direction of the arrow are advanced to a first clamping wheel 9 where they are grasped and advanced onto a stepwise or continuously rotating table 10 of a device for evacuating and fully closing the packages 6. Table 10 supports a plurality of vacuum hoods 11. The hermetically closed packages 6 are thereafter taken by a second clamping wheel 12 from the table 10 and advanced to the conveyor track 13 where the earlier-closed transverse seam of the bags 6 is folded over and the upstanding flaps are folded inwardly to obtain finished packages 6'.

The finished packages 6' are subsequently advanced to a removal track 14 at the remote end of which an apparatus 15 may be provided for forming a single package (collection box) from a plurality of packages 6'. The removal conveyor track 14 constitutes an accumulation track for the final processing apparatus 15.

The structure and mode of operation of the mandrel wheel 3 is disclosed in Swiss Patent No. 434,953. While in that patent, contrary to the arrangement shown in FIG. 1, an apparatus is described for the simultaneous manufacture of two bags, the mandrel wheel described therein can find application in an apparatus according to FIG. 1, since the mode of operation is the same whether the mandrel wheel is used for making two bags or only a single bag. A transverse knife severs wrapper pieces from a continuous wrapper web 1. The severed wrapper portions are shaped on a box to form a hose which is inserted on a mandrel 2 of the mandrel wheel 3. Thereafter, a longitudinal seam is provided in a known manner by welding or gluing. After the mandrel wheel 3 has been rotated in the direction of the arrow, bottom folds are formed and the bottom is closed. Thereby the bag is finished and, if desired, at the mandrel wheel 3 a station 4 may be provided to which a cardboard blank is advanced and folded. At further stations about the circumference of the mandrel wheel 3 the outer cardboard blank is folded to form a bottom which is subsequently glued together The dosing and filling station may be constructed as disclosed in Swiss Patent No. 595,241. In a funnel-shaped supply channel which has a cylindrical discharge channel there is situated a metering screw. A sensor at the conveyor track 8 determines when a bag 6 is positioned underneath a filler opening. A signal generated upon such an occurrence serves for energizing the metering screw for discharging an accurate quantity of flowable (bulk) material.

The evacuating and closing device 10 may be constructed as disclosed in Swiss Patent No. 394,932. Also, an apparatus for the grouping of articles may be conventional and may be structured as disclosed in Swiss Patent No. 435,098.

In a packing machine (packaging line) as outlined above, it has been fund, however, that in case of an interruption in the operation the risks are high that in all locations defective bags are produced if it is assumed that a lack of wrapping material 1 has been determined and the packing line has been immediately brought to a standstill. At that moment, on the mandrel wheel 3 bags in different stages of preparation are present, including bags which are not yet entirely closed. In case seams are formed by the applying an adhesive, the latter may readily soil the mandrel. In any event, the adhesive dries even on those bags which are not yet finished and thus defective seams result.

There is a similar occurrence in the metering and filling apparatus. In case the metering process has not yet been completed as the machine is shut down, the bulk material may trickle through because the discharge opening of the apparatus has not been completely closed. This results in an incorrectly filled bag.

In the closing and evacuating device 10 air may penetrate after shutdown, involving the risk that several bags are not properly evacuated. Further, incomplete sealing of the bags may occur.

It is apparent that upon stoppage nothing further occurs at the removal track 14 because there the number of collected bags is determined by counting. During restart, however, the defective or improperly filled bags have to be separated out and removed upon arrival thereon, which involves high operating costs and significant losses of material.

According to the invention, by means of a sensor 21 the supply of the wrapper material 1 is monitored. Also, the presence of the bulk material in the charging funnel is determined by a sensor 22 which may be a fill-level sensor associated with storage bin for the bulk material. Since a further disturbance may be caused on the removal conveyor 14 in case a backup occurs, a sensor 23 is provided which monitors the proper operation of the removal conveyor 14.

Figure 2:
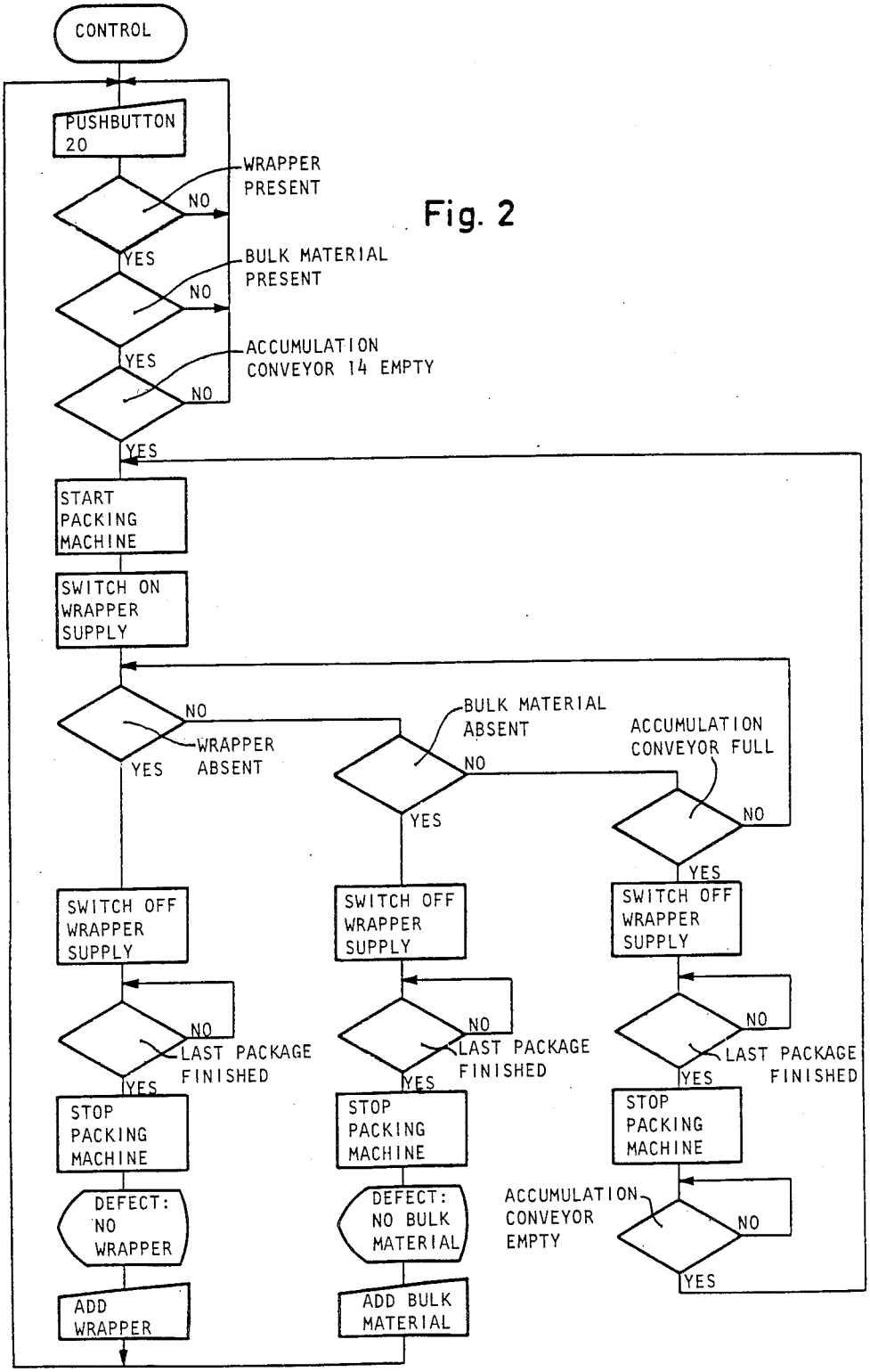
FIG. 2 is a flow chart for the control commands for performing the method according to the invention.

For a command control according to the flow chart of FIG. 2, a sensor 24 arranged at the end of the track 13 determines whether the tracks 5, 8, 13, together constituting a first conveying lane, are void of any bags 6 or 6'. Such a determination may be effected, for example, by a feeler and a counting device which counts forward or backward.

After machine start is commanded by actuating the pushbutton 20, operation may in fact commence as a result of the cumulative decision with the aid of the sensor 21 (confirming the presence of the wrapper supply 1), the sensor 22 (confirming the presence of bulk material supply at the metering and filling station 7) and the sensor 23 (confirming that the removal conveyor 14, constituting a second conveying lane, is empty). Stated differently, it is first determined whether wrapper material and bulk material is present and whether the tracks 8, 13 and 14 are empty. The machine can be started only if all parameters are positive.

As soon as one of the sensors 21, 22 or 23 transmits an error signal indicating to a control device 25 that either no wrapper material or no bulk material is present or that the removal track 14 is full, the advancing of wrapper material 1 is immediately stopped by a command signal from the control device 25 and the sensor 24 is activated at the end of the track 13. The control device may be a conventional computer adapted to perform all command operations in response to functional parameters in accordance with the flow chart of FIG. 2.

As soon as the last closed bag 6' has left the track 13, the packaging line is switched off to make possible a normal start after the disturbance or defect has been eliminated, that is, to permit a resumption of the machine operation without a malfunctioning caused by the original defect and without the disturbances characterizing the functioning of machines with prior art operating methods as described earlier.

By virtue of the monitoring of the most important functions, each defect can be immediately localized and the machine is turned off only when all bags, as viewed from the supply location of the wrapper material 1 until the transfer onto the removal conveyor 14, are respectively fully made, filled, closed and transferred. It is apparent that for this purpose the sensor 22 at the metering and filling station 7 has to be set to a level in which there is still possible a correct filling of all the bags situated on the mandrel wheel 3 and between the mandrel wheel 3 and the metering and filling station 7.

It is to be understood that additional sensors may be provided at other critical locations such as, for example, at the station supplying the cardboard blank 4.

As sensors of both types either mechanical or electronic sensors may be used. The sensor 21 associated with the feed of the wrapper material 1 may be a sensor for determining the presence of an empty paper roll and/or as a sensor for determining the lack of paper. Instead of the sensor 24 a counter or delay switch may be used which, after the lapse of a certain time period triggers the machine shutoff process if no signal indicating a throughgoing bag is received.

The present disclosure relates to subject matter contained in Swiss Patent Application No. 4623/86 (filed Nov, 19th, 1986) which is incorporated herein by reference.

It will be understood that the above description of the present invention is susceptible to various modifications, changes and adaptations, and the same are intended to be comprehended within the meaning and range of equivalents of the appended claims

What is claimed is:

1. A method of switching on and switching off a packaging line for packing bulk material in individual packages; said packaging line having a first conveying lane, bag-forming means for making bags and transferring the bags to said first conveying lane; wrapper sheet supplying means for advancing a wrapper sheet to said bag-forming means; metering and filling means arranged at said first conveying lane for charging said bags advanced on said first conveying lane with bulk material of predetermined quantities, closing means arranged at said first conveying lane for closing each filled bag advanced on said first conveying lane from said metering and filling means and a second conveying lane for receiving the closed bags from said first conveying lane for accumulating and further conveying the closed bags; comprising the following steps:

(a) sensing the absence and presence of an operationally sufficient quantity of wrapper sheet supply for said bag-forming means;

(b) sensing the absence and presence of an operationally sufficient quantity of bulk material supply in said metering and filling means (c) sensing the absence and presence of said bags on said first conveying lane;

(d) sensing the quantity of said bags on said second conveying lane to determine a receptiveness or non-receptiveness of said second conveying lane;

(e) allowing a start-up of the packaging line only if said sensing steps (a) and (b) determine a presence and said sensing step (d) determines a receptiveness; and (f) allowing a stoppage of said packaging line only if said sensing step (c) determines an absence.

2. A method as defined in claim 1, wherein step (f) further comprises the step of allowing said stoppage only if at least one of said sensing steps (a) and (b) determines an absence simultaneously with a determination of absence by said step (c).

3. An apparatus for switching on and switching off a packaging line for packing bulk material in individual packages; said packaging line having a first conveying lane, bag-forming means for making bags and transferring the bags to said first conveying lane; wrapper sheet supplying means for advancing a wrapper sheet to said bag-forming means; metering and filling means arranged at said first conveying lane for charging said bags advanced on said first conveying lane with bulk material of predetermined quantities, closing means arranged at said first conveying lane for closing each filled bag advanced on said first conveying lane from said metering and filling means and second conveying lane for receiving the closed bags from said first conveying lane for accumulating and further conveying the closed bags, comprising (a) first sensing means for sensing the absence and presence of an operationally sufficient quantity of wrapper sheet supply for said bag-forming means;

(b) second sensing means for sensing the absence and presence of an operationally sufficient quantity of bulk material supply in said metering and filling means;

(c) third sensing means for sensing the absence and presence of said bags on said first conveying lane;

(d) fourth sensing means for sensing the quantity of said bags on said second conveying lane to determine a receptiveness or non-receptiveness of said second conveying lane; and (e) control means for allowing a start-up of the packaging line only if said first and second sensing means determine a presence and said fourth sensing means determines a receptiveness and for allowing a stoppage of said packaging line only if said third sensing means determines an absence.

4. An apparatus as defined in claim 3, wherein said first, second and fourth sensing means each comprise a feeler sensor.

5. An apparatus as defined in claim 3, wherein said fourth sensing means comprises an accumulation sensor; said first conveying lane having a bag transfer end and said second conveying lane having a bag receiving end; said accumulation sensor being situated between said bag transfer end and said bag receiving end.

6. An apparatus as defined in claim 3, wherein said first sensing means is situated at said wrapper sheet supplying means.

7. An apparatus as defined in claim 3, further wherein said metering and filling means comprises bulk material storage bin and said second sensing means comprises a fill-level sensor operatively connected with said storage bin.

8. An apparatus as defined in claim 3, wherein said third sensing means comprises a feeler sensor situated at said first conveying lane and arranged for determining the passage of the last filled bag from said first conveying lane to signal an empty state thereof.

* * * * *